US005173636A

United States Patent [19]

Son

[11] Patent Number: 5,173,636

[45] Date of Patent: Dec. 22, 1992

[54] PANEL OF METAL BACKED COLOR CATHODE RAY TUBE AND MANUFACTURING METHOD THEREOF

[75] Inventor: Myeong S. Son, Pusan, Rep. of Korea

[73] Assignee: Samsung Electronics Co., Ltd., Suwon, Rep. of Korea

[21] Appl. No.: 436,636

[22] Filed: Nov. 15, 1989

[30] Foreign Application Priority Data

May 4, 1989 [KR] Rep. of Korea ..... 89-6046

[51] Int. Cl.[5] ..... H01J 9/20; H01J 29/10

[52] U.S. Cl. ..... 313/466; 313/479; 445/58; 427/282

[58] Field of Search ..... 313/466, 479; 118/720; 445/52, 58; 427/68, 250, 282

[56] References Cited

U.S. PATENT DOCUMENTS

| | | | |
|---|---|---|---|
| 2,472,988 | 6/1949 | Rosenthal | 313/466 |
| 2,944,322 | 7/1960 | Colgate | 313/466 |
| 3,562,518 | 2/1971 | Savorik | 313/479 |
| 4,601,922 | 7/1986 | Moroboshi et al. | 427/250 |
| 4,623,820 | 11/1986 | Deal et al. | 313/466 |

FOREIGN PATENT DOCUMENTS

| | | | |
|---|---|---|---|
| 52-69812 | 6/1977 | Japan | 313/466 |

*Primary Examiner*—Donald J. Yusko
*Assistant Examiner*—John E. Giust
*Attorney, Agent, or Firm*—Robert E. Bushnell

[57] ABSTRACT

A panel of a metal backed color cathode ray tube and a manufacturing method thereof are disclosed which are characterized in that the height of the graphite remaining on the skirt is higher than or same as the metal deposition height of the deposited metal layer, and that a shielding plate having a height higher than or same as the cutting height of the graphite is used on a deposition dolly for forming the deposited metal layer. According to the present invention, the deposited metal layer is neither floated nor detached due to the combustion of the organic materials used in forming the luminescent layer or the intermediate layers such as the filming layer, and therefore, the defect rate due to the blocking of the holes of the shadow mask is markedly reduced, thereby making it possible to save labor and materials in producing the product, and concomitantly upgrading the quality of the metal backed color cathode ray tube.

24 Claims, 1 Drawing Sheet

PANEL OF METAL BACKED COLOR CATHODE RAY TUBE AND MANUFACTURING METHOD THEREOF

FIELD OF THE INVENTION

The present invention relates to a panel of metal backed color cathode ray tube, and a manufacturing method thereof.

BACKGROUND OF THE INVENTION

The metal backed cathode ray tube is manufactured by depositing a metal layer such as an aluminum layer on the back of the luminescent layer in order to improve the luminance, to reinforce the potential, and to prevent the burning of the luminescent layer. An example of such a metal backed color cathode ray tube is disclosed in Japanese Patent Publication No. Sho 56-25736, the constitution of which is illustrated in FIG. 1. According to this technique, graphite is spread in the form of stripes on the inner surface of the face plate F of the panel P, thereby forming a black matrix B. This metal backed color cathode ray tube comprises: the above mentioned black matrix B; a luminescent layer L formed by alternately depositing R,G,B luminescent materials containing an organic ingredient such as PVA as the base through the use of a photo etching method; a filming layer M composed of organic ingredients such as acryl emulsion for separating the luminescent layer L from a deposited metal layer A to be described later; and a deposited metal layer A made of aluminum layer and the like and deposited through the use of an electric deposition method so as for the layer A to serve as a metal back.

In the finishing process, such a panel is sealingly joined with a funnel (not shown), thereby forming a bulb. However, if impurities adhered to the seal edge E during the joining, cracks will be produced, and therefore, there will be the risk that the cathode ray tube might implode. Therefore, the portions of the layers deposited on unnecessary areas during the above described spreading processes are removed by proper methods. That is, the graphite forming the black matrix B is cut away by means of a chemical such as ammonium acid fluoride ($NH_4$ FHF), and the superfluous portions of the luminescent layer L and the filming layer M are washed off by means of a wiper of high pressure water, while the deposited metal layer A is deposited in such a manner that a proper shielding plate is installed on the deposition dolly so as for only the required areas to be deposited.

However, a stud pin T for installing a shadow mask (not shown) protrudes from a skirt S of the panel P, and therefore, it is difficult to carry out a complete washing by means or wiper with high pressure water, with the result that serious problems are generated during the baking process due to the residue of organic materials of the luminescent layer and the filming layer.

A baking is carried out to burn off (remove) the organic materials such as PVA and acryl emulsion by heating the panel to a high temperature, so that the electron beams emitted from the electron gun should not lose their energies due to the organic materials before they reach the luminescent layer. However, if a deposited metal layer A is formed upon the surface of the residue organic materials O adhered on the skirt S, then the deposited metal layer will swell up to float above the residue organic material during the baking process due to the combustion gas of the organic materials, and this floated-up metal layer A will be detached away after the manufacturing of the cathode ray tube to block up the holes of the shadow mask, this having been one of the main factors for the hole-blocking defects. Therefore, in order to remove the detached materials, a salvaging process had to be carried out, with the adverse result that much labor and materials had to be squandered. According to the investigations carried out by the present inventor, the defective product rate due to the detachment of the deposited metal layer A such as aluminum layer occupies 20~30% of the total hole-blocking defects.

SUMMARY OF THE INVENTION

The present invention is intended to overcome the above described disadvantages of the conventional techniques.

Therefore it is the object of the present invention to provide a panel of a metal backed color cathode ray tube and a manufacturing method thereof, in which the deposited metal layer is neither floated up nor detached after the combustion of the organic materials.

The idea of the present inventor for achieving the above object lies in the fact that a deposited metal layer such as an aluminum layer attached upon a graphite layer is neither floated nor detached during the combustion of the organic materials in spite of the discharge of the combustion gas, because graphite has superior adherence and neither combusts nor produces combustion gases during a baking process.

Thus the panel of a metal backed color cathode ray tube according to the present invention comprises a black matrix, a luminescent layer and a deposited metal layer, each of which is sequentially deposited on the inner surface of the panel consisting of a face plate and a skirt, characterized in that the height of graphite on the skirt after the formation of the black matrix is made to be higher than or same as the height of the deposited metal layer.

The manufacturing method suitable for manufacturing the panel of the present invention is characterized in that a shielding plate having a height higher than or same as the cutting height of the graphite is applied on the deposition dolly for forming the above described deposited metal layer.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
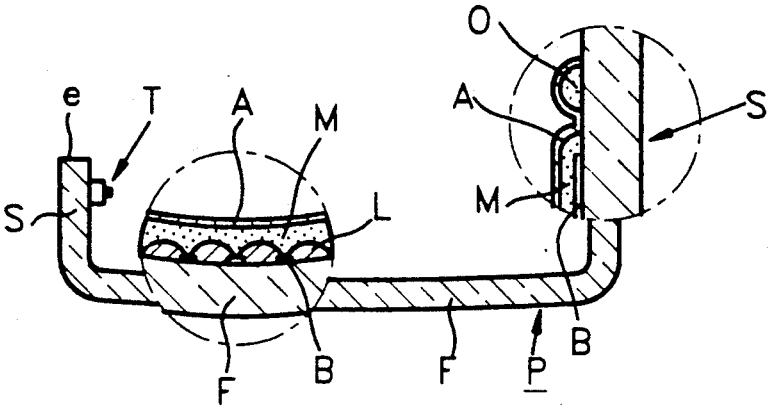
FIG. 1 (PRIOR ART)
FIG. 1 is a partially enlarged sectional view of the panel for a conventional metal backed cathod ray tube.
Figure 2:
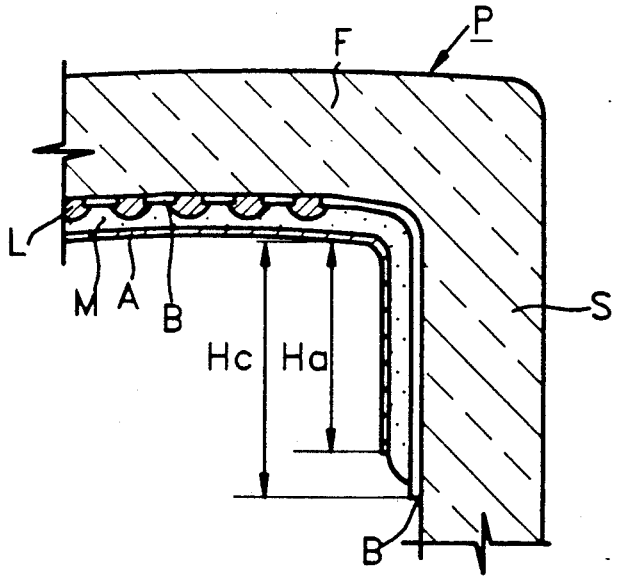
FIG. 2 is a fragmentary sectional view of the critical portion of the panel for the metal backed color cathode ray tube manufactured according to the method of the present invention.

The panel P of the metal backed color cathode ray tube according to the present invention illustrated in FIG. 2 is manufactured by sequentially depositing: a black matrix B formed by spreading graphite in the form of stripes on the inner surface of a face plate F through the use of a photo etching method and the like; a luminescent layer L formed by alternately depositing three (R,G,B) luminescent materials between the black matrices B; a filming layer M for separating the luminescent layer L and a deposited metal layer A; and the deposited metal layer A, desirably an aluminum layer deposited on the filming layer M through the use of an electric deposition method and the like. This constitution so far is not much different from that of the conventional panel.

The unique feature of the present invention lies in the portion of the skirt S of the panel P, and is constituted such that the height of the graphite (to be called hereinafter "graphite height Hc") from the inner surface of the face plate of the panel (or the luminescent layer) where the graphite is cut off in the graphite cutting process after adhering it on the inner surface of the skirt S during the spreading of the black matrix, B is made to be higher than or same as the height of the deposited metal layer A (to be called hereinafter "metal layer height Ha").

Figure 3:
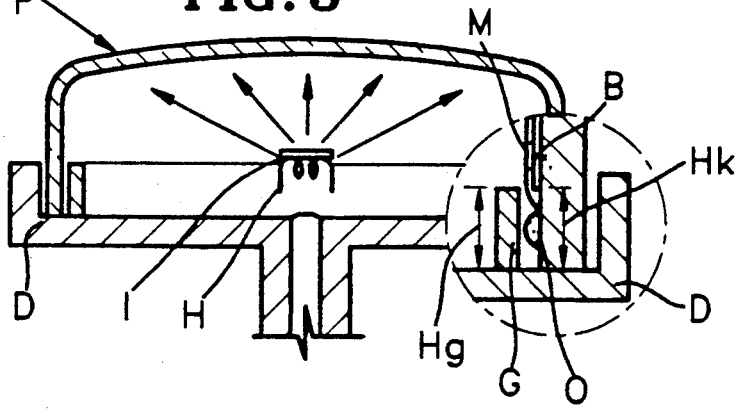
FIG. 3 is a partially enlarged sectional view of the critical portion of the panel for the metal backed color cathode ray tube according to the present invention, which is being subjected to the aluminum deposition process on a deposition dolly.

The method of forming the graphite height Hc higher than or same as the metal layer height Ha on the panel P is carried out as shown in FIG. 3 in such a manner that a shielding plate G is used during the deposition of the deposited metal layer A on the inner surface of the panel so as for the metal not to be deposited on the place where the graphite is cut off. It is desirable that the shielding plate G should be made of a material such as fluoric resin (trade name: Teflon) which is strong against the heat and not harmful to a glass panel, and the shielding plate G is provided with a contour substantially corresponding to the inner boundary of the skirt S of the panel P. The height Hg of this shielding plate G should be higher than or same as the cutting height Hk in the place where the graphite adhered on the skirt S of the panel P is cut off. In FIG. 3, Reference code D indicates a deposition dolly, I an ingot for the deposited metal, and H a heater.

The process of forming the panel of the present invention through the use of the shielding plate G having a height Hg higher than or same as the cutting height Hk will be described more specifically below. The black matrix B is spread on the inner surface of the face plate F of the panel P, and the superfluous graphite adhered on the skirt S is cut off as much as the cutting height Hk by means of a proper chemical such as ammonium fluoride, so that the graphite should remain as high as the graphite height Hc.

Then the R,G,B luminescent materials are alternately deposited using an organic medium such as PVA together with an adhesive or photoresist so as for the luminescent layer to be formed, and thereafter, a filming layer M is spread in order to prevent the lowering of the reflecting function of the deposited metal layer A, while the deposited metal layer A is deposited on the rear side of the filming layer M.

The space between the panel P and the deposition dolly D is evacuated by means of a vacuum pump (not shown) to form a required vacuum space, and then, the deposition metal ingot I is heated by the heater H to produce deposition metal vapors which are to be made to adhere on the inner surfaces of the face plate F and the skirt S of the panel P. Here, the shielding plate G according to the present invention is installed on the inner circumference of the skirt S, and the height Hg of the shielding plate G is higher than or same as the cutting height Hk of the graphite, with the result that the deposited metal layer A is not formed on the surface of the organic material O where the graphite layer does not exist.

The panel P which has undergone the process of forming the deposited metal layer A is subjected to a proper cleaning step, and then, is put into a baking furnace where a baking process is carried out, and where the organic ingredients contained in the luminescent layer L and the filming layer M are all burned and discharged in the form of gas.

Even if the organic materials contained in the portions of the layers where the graphite layer exists on the skirt S are burned and discharged across the deposited metal layer A, the graphite layer located below maintains a strong adherent strength, and therefore, the deposited metal layer A is neither floated nor is detached, while the portions where no graphite layer exists are not provided with a deposited metal layer A so as for the organic materials to be burned and discharged freely, and so as for them not to give any adverse effect to other portions.

According to the present invention as described above, the deposited metal layer is neither floated nor detached due to the combustion of the organic materials used in forming the luminescent layer or the intermediate layers such as the filming layer, and therefore, the defect rate due to the blocking of the hole of the shadow mask is markedly reduced, thereby making it possible to save the labor and materials, and making it possible to produce a high quality color cathode ray tube.

What is claimed is:

1. A panel of a metal-backed color cathode ray tube, comprising:
   - a glass face plate and a glass skirt forming a panel of a color cathode ray tube; and
   - a black matrix, a luminescent layer and a metal layer each sequentially disposed on an inner surface of said panel, with a length of said black matrix remaining on an inner surface of said skirt next adjoining said inner surface of said panel, said length as measured from said inner surface of said panel and along said inner surface of said skirt, being the same as or greater than the length of the metal layer as measured from said inner surface of said panel and along said inner surface of said skirt.

2. The panel of claim 1, wherein said luminescent layer is formed of alternate deposits of red, green and blue luminescent material.

3. The panel of claim 1, wherein said luminescent layer comprises:
   - alternate deposits of red, green and blue luminescent material disposed over said black matrix; and
   - a film disposed to cover and separate said alternate deposits from said metal layer.

4. The panel of claim 1, wherein said luminescent layer comprises:
   - alternate deposits of red, green and blue luminescent material disposed over said black matrix; and a film disposed to cover and separate said alternate deposits from said metal layer.

5. The panel of claim 1, further comprised of a shield disposed prior to disposition of said metal layer, in juxtaposition to but separated from said inner surface of said skirt, said shield having a contour substantially conforming to said inner surface of said skirt and a length, as measured from a distal end of said skirt most distant from said inner surface of said panel, equal to or greater than any distance between said distal end of said skirt and said black matrix remaining on said inner surface of said skirt.

6. The panel of claim 1, wherein said black matrix is formed of graphite.

7. The panel of claim 6, wherein said luminescent layer is formed of alternate deposits of red, green and blue luminescent material.

8. A panel of metal-backed color cathode ray tube, comprising:

a glass face plate and a glass skirt forming a panel of a color cathode ray tube; and a black matrix, a luminescent layer and a metal layer each sequentially disposed on an inner surface of said panel, with a height of said luminescent layer remaining on an inner surface of said skirt adjoining said inner surface of said panel, said height as measured from said inner surface of said panel and along said inner surface of said skirt being the same as or greater than the height of the metal layer as measured from said inner surface of said panel and along said inner surface of said skirt.

9. The panel of claim 8, wherein said luminescent layer is formed of alternate deposits of red, green and blue luminescent material.

10. The panel of claim 8, wherein said luminescent layer comprises:

alternate deposits of red, green and blue luminescent material disposed over said black matrix; and a film disposed to cover and separate said alternate deposits from said metal layer.

11. The panel of claim 8, further comprised of a shield disposed prior to disposition of said metal layer, in juxtaposition to but separated from said inner surface of said skirt, said shield having a contour substantially conforming to said inner surface of said skirt and a length, as measured from a distal end of said skirt most distant from said inner surface of said panel, equal to or greater than any distance between said distal end of said skirt and said black matrix remaining on said inner surface of said skirt.

12. The panel of claim 8, wherein said black matrix is formed of graphite.

13. The panel of claim 12, wherein said luminescent layer is formed of alternate deposits of red, green and blue luminescent material.

14. The panel of claim 12, wherein said luminescent layer comprises:

alternate deposits of red, green and blue luminescent material disposed over said black matrix; and a film disposed to cover and separate said alternate deposits from said metal layer.

15. A panel of a metal backed color cathode ray tube, comprising:

a glass face plate and a glass skirt forming said panel, a black matrix formed from graphite and spread in the form of stripes on an inner surface of said face plate, a luminescent layer formed by alternately depositing color luminescent materials containing an organic ingredient as a base over said black matrix and over areas of said inner surface not covered by said black matrix, organic residue left on said skirt during removal of superfluous portions of said luminescent layer and an organic film layer deposited over said luminescent layer, and a metal layer deposited over said organic film layer, characterized in that the graphite of said black matrix on said skirt extends along said skirt for a first distance and that a section of said metal layer, parallel to said skirt, extends along said luminescent layer partially coextensive with said black matrix and said luminescent layer, for a distance less than or equal to said first distance.

16. The panel of claim 15, wherein said black matrix is formed of graphite.

17. The panel of claim 15, wherein said luminescent layer is formed of alternate deposits of red, green and blue luminescent material as said color luminescent material.

18. The panel of claim 15, wherein said luminescent layer comprises:

alternate deposits of red, green and blue luminescent material disposed over said black matrix; and a film disposed to cover and separate said alternate deposits from said metal layer.

19. The panel of claim 15, further comprised of a shield disposed prior to disposition of said metal layer, in juxtaposition to but separated from said inner surface of said skirt, said shield having a contour substantially conforming to said inner surface of said skirt and a length, as measured from a distal end of said skirt most distant from said inner surface of said panel, equal to or greater than any distance between said distal end of said skirt and said black matrix remaining on said inner surface of said skirt.

20. A process for manufacturing a panel of a metal backed color cathode ray tube, comprising:

forming a matrix of graphite on an inner surface of a glass panel and glass sidewalls of the panel for a cathode ray tube;

cutting an edge of said matrix around a first inner perimeter of the sidewalls of the panel at a first distance along the sidewalls;

forming a luminescent layer over said matrix of graphite; and depositing a layer of metal over said luminescent layer extending along said sidewalls by a second distance equal to or less than said first distance.

21. The process of claim 20, further comprised of interposing a shield between a source of metal used for said step of depositing a layer of metal and a periphery of the sidewalls of the panel not covered by said matrix of graphite while depositing said layer of metal.

22. The process of claim 21, further comprised of interposing a shield having a desired height between a source of metal used for depositing a layer of metal and a periphery of the sidewalls of the panel not covered by said matrix of graphite while depositing said layer of metal, wherein said desired height of said shield is equal to or greater than a length of the sidewalls not covered by said matrix of graphite.

23. A manufacturing method for a panel of a metal backed color cathode ray tube, said panel having a glass face plate and glass skirt, comprising:

a step of forming a black matrix of graphite on said panel;

a step of cutting off a portion of said graphite a first distance along said skirt of the panel;

a step of forming a luminescent layer over said black matrix and areas of said face plate and skirt not covered by said black matrix;

a step of forming a film layer composed of organic ingredients over said luminescent layer;

a step of depositing a metal layer over said film layer for a desired distance equal to or less than said first distance; and wherein said step of depositing uses a shielding plate having a desired height mounted on a deposition dolly for depositing said metal layer to ensure that said metal layer does not exceed said desired distance.

24. A manufacturing method for a panel of a metal backed color cathode ray tube, said panel having a glass face plate and glass skirt, comprising the steps of:

forming a black matrix of graphite on said panel;

cutting off a portion of said graphite a first distance along said skirt of said panel;

forming a luminescent layer over said black matrix and over areas of said face plate and said skirt not covered by said black matrix, wherein said luminescent layer contains organic ingredients as a base;

forming a film layer composed of organic ingredients over said luminescent layer;

depositing a metal layer over said film layer for a desired distance equal to or less than said first distance, wherein said step of depositing uses a shielding plate having a desired height mounted on a deposition dolly for depositing said metal layer to ensure that said metal layer does not exceed said desired distance;

washing off superfluous portions of said luminescent layer and said film layer; and baking said panel in a baking furnace for burning and discharging said organic ingredients in the form of a gas, wherein during said step of baking said metal layer is prevented from floating or detaching due to said graphite in said black matrix.

* * * * *

UNITED STATES PATENT AND TRADEMARK OFFICE

CERTIFICATE OF CORRECTION

PATENT NO. : 5,173,636

DATED : 22 December 1992

INVENTOR(S) : Myeong-Sin Son

It is certified that error appears in the above-identified patent and that said Letters Patent is hereby corrected as shown below:

On the title page, Item [75]:
Change "Myeong S. Son" to --Myeong-Sik Son--.

Signed and Sealed this

Twenty-fifth Day of January, 1994

*Attest:*

Bruce Lehman

BRUCE LEHMAN

*Attesting Officer*

*Commissioner of Patents and Trademarks*